United States Patent [19]

Epstein

[11] Patent Number: 4,611,842

[45] Date of Patent: Sep. 16, 1986

[54] RELEASEABLE HOOK

[76] Inventor: Irving Epstein, 2901 Utah Ave. S., Seattle, Wash. 98124

[21] Appl. No.: 651,100

[22] Filed: Sep. 17, 1984

[51] Int. Cl.[4] ..... B66C 1/38

[52] U.S. Cl. ..... 294/82.33; 294/905

[58] Field of Search ..... 294/82.24, 82.27, 82.26, 294/82.3, 82.31, 82.32, 82.33, 82.34, 88, 75, 103.1, 104, 66.1, 82.28, 905; 24/232, 233, 234, 235, 241 P, 241 PP, 241 R; 114/230, 252, 238

[56] References Cited

U.S. PATENT DOCUMENTS 4,034,992 7/1977 Epstein ..... 294/82.33

4,149,746 4/1979 Androski ..... 294/82.31

4,526,143 7/1985 Williams ..... 294/905

*Primary Examiner*—James B. Marbert

*Attorney, Agent, or Firm*—T. W. Secrest

[57] ABSTRACT

This invention is for a remotely controlled release hook. The operator of the release hook is at a safe distance away from the release hook and therefore away from a dangerous and hazardous area. The operator need not travel, in hazardous conditions, to the release hook to operate the release hook. Also, the operator need not be near the release hook to release the hook and therefore is away from a dangerous area or position. The release hook is radio controlled and comprises a transmitter and a receiver.

56 Claims, 13 Drawing Figures

RELEASEABLE HOOK

THE BACKGROUND OF THE INVENTION

A releaseable hook for a rope or line is sometimes positioned on a barge or on a platform such as an oil well platform or a docking platform.

A barge or a number of barges are often loaded with refuse or other material and towed out into the ocean. If the barge is loaded with refuse and towed out into the ocean the refuse is dumped into the ocean. Once in awhile the water is so rough in the ocean that it is dangerous to have the barge or barges attached to a towing vessel and it is necessary to release the barges from the towing vessel. The water may be rough with dangerous waves. With a manual release hook on the barge or barges it is necessary for an individual to travel from the towing vessel to the barge or barges and release the manual release hook to allow the tow line to release. Again, the operator traveling from the towing vessel to the barge or barges must travel over rough water with dangerous waves. A further handicap is there may be poor visibility between the towing vessel and the barge because of a storm and rain or fog because of darkness. It is my understanding that some operators have been lost at sea and, presumably, drowned while trying to release the releaseable hook on the barge.

Similarily, an oil well platform or a docking platform out in a body of water has a release hook. At times it is necessary, with a manual release hook, for an operator to travel to the platform. The comments with respect to dangerous waves and poor visibility as above stated for a barge are also applicable with respect to the platform. It is dangerous for an operator to travel over the rough water to the platform to manually release the release hook.

A further disadvantage associated with the manual release hook is an inherent possibility of injuring the operator. With the rope or cable around the release hook an operator must manually release the hook. This means that the operator stands fairly close to the hook and must stand close to the pedestal and/or the frame for the release hook. The operator, in releasing the lock for locking the release hook in position, is close to the release hook and the rope or cable rotates the release hook rapidly. The rapidly rotating release hool hits the stop or brake and rotates in the opposite direction. Also, the frame holding the release hook may rotate around the support pedestal. The operator near the frame and the support pedestal may be hurt by the rapidly rotating release hook and/or may be hurt by the rotating frame. Therefore, the releasing of the release hook at a remote position is desirable as there is less possibility of the operator being injured.

The releasing of a manual release hook on a barge or a platform in inclement weather can be a dangerous undertaking and, unfortunately, can result in the death of the operator. The transportation of the operator from the home base such as the on shore home base for the oil well platform or the buoy or from the home base such as a tug boat pulling the barge can be dangerous. The travelling from the home base to the oil well platform or the barge can be one whereby the operator may drown due to capsizing of the boat. With the releasing of the release hook at the home base, without the necessity of the operator travelling from the home base to the oil well platform or barge, means that there is less possibility of the operator being hurt or killed. Therefore, the remote releasing of the release hool has desirable side effects with respect to the elimination of injury or death to the operator.

THE GENERAL DESCRIPTION OF THE INVENTION

This invention is directed to a remotely controlled release hook. An operator at a considerable distance from the release hook can control the release of the release hook to release a rope or a cable. The operator can, up to a distance of about six miles from the releaseable hook, release the releaseable hook.

After the releaseable hook has been released the operator can travel, in good weather and in safe weather, to the release hook on a barge or a platform and reset the releaseable hook for receiving the eye of a rope or cable. The eye of the rope or cable can be positioned around the releaseable hook. Then, at a remote distance the operator can control the release and the rotation of the releaseable hook.

With the operator remotely positioned with respect to the releaseable hook there is a safety factor in that the operator does not have to travel during inclement weather over dangerous water to the barge or platform to release the releaseable hook. With the operator not having to travel in inclement weather there is less possibility of the operator being injured or killed because of the lack of travel.

Another safety factor is that the operator is not near the releaseable hook when the releaseable hook rotates and the operator is not in a position to be injured by the rotating release hook.

The operator by means of radio signals can control the release of the releaseable hook up to a distance of about six miles. Normally, the operator at a distance of much less than six miles can control the release of the releaseable hook to release the eye of a rope or cable so that the barge can move or a ship attached to the platform can be free to move away from the platform.

THE DRAWINGS

Figure 10:
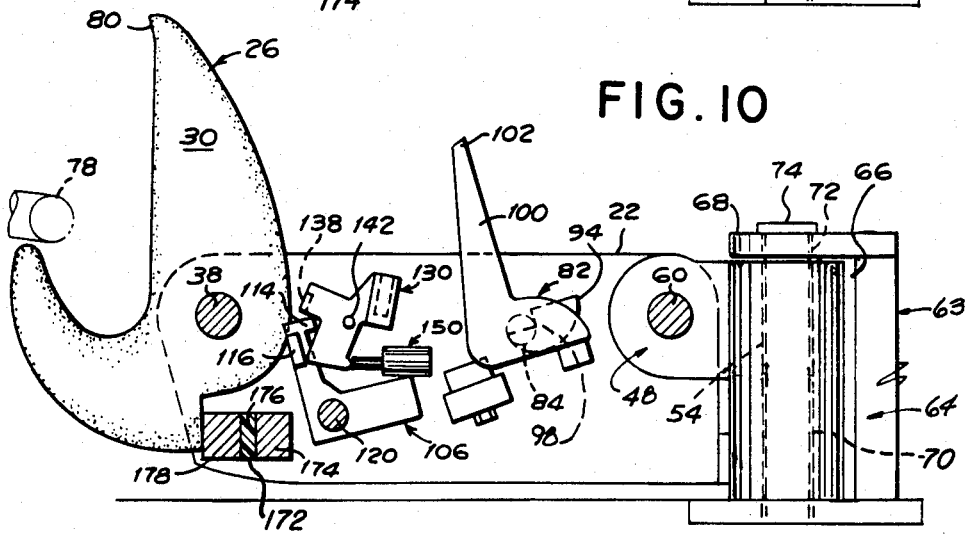
Figure 11:
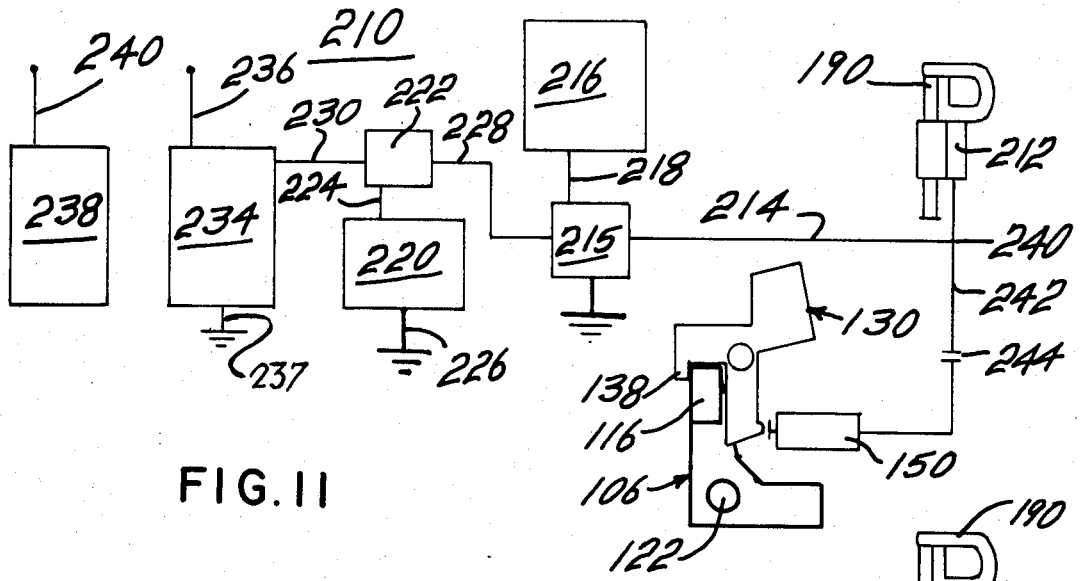
Figure 12:
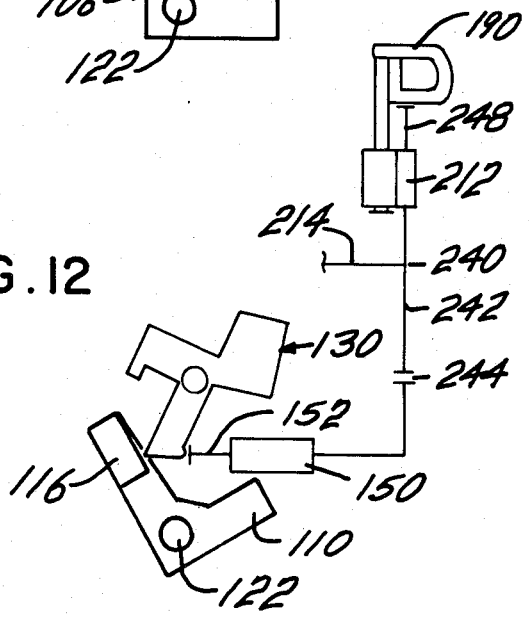
Figure 13:
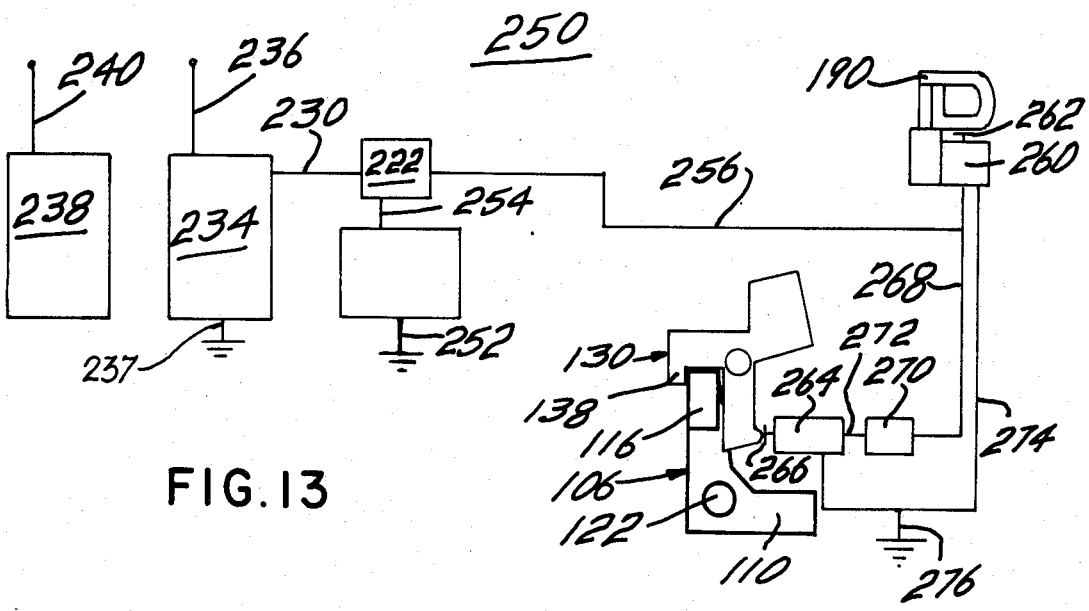

FIG. 10 is a fragmentary view illustrating the inner lock being moved away from the locking arm and the locking arm being moved away from the locking pawl so that the locking pawl can rotate out of position to allow the U-shaped hook to rotate and, as is seen in FIG. 10, the U-shaped hook has rotated so as to allow release of a line; and, FIG. 11 is a schematic illustration of the hydraulic system of the release hook and illustrates the locking arm in a locking position with respect to the locking pawl;

FIG. 12 is similar to FIG. 11 and illustrates the locking arm in a release position with respect to the locking pawl; and, FIG. 13 is a schematic illustration of an electrical system as part of the release hook and illustrates the locking arm in a locking position with respect to the locking pawl.

THE DETAILED DESCRIPTION OF THE INVENTION

The invention is a releaseable hook 20.

There is positioned between the sides 22 and 24 a U-shaped hook 26 having a hook portion 28 and a main body portion 30.

In the sides 22 and 24, are passageways 32 and 34. Also, in the U-shaped hook 26 there is a passageway 36.

A bolt 38 projects through the passageways 34, 36 and 32 so as to position the U-shaped hook 26 between the sides 22 and 24. It is understood that passageway 36 is of a larger internal diameter than the external diameter of the bolt 38 so that the U-shaped hook 26 is free to rotate around the bolt 38. There is a nut 40 which screws onto the threaded end of the bolt 38. Further, between the U-shaped hook 26 and the side 24, there is spacer or washer 42 so as to position the main body portion 30 of the U-shaped hook near the side 22. It is to be understood that the bolt 38 is positioned in a passageway in the spacer or washer 42.

Figure 1:
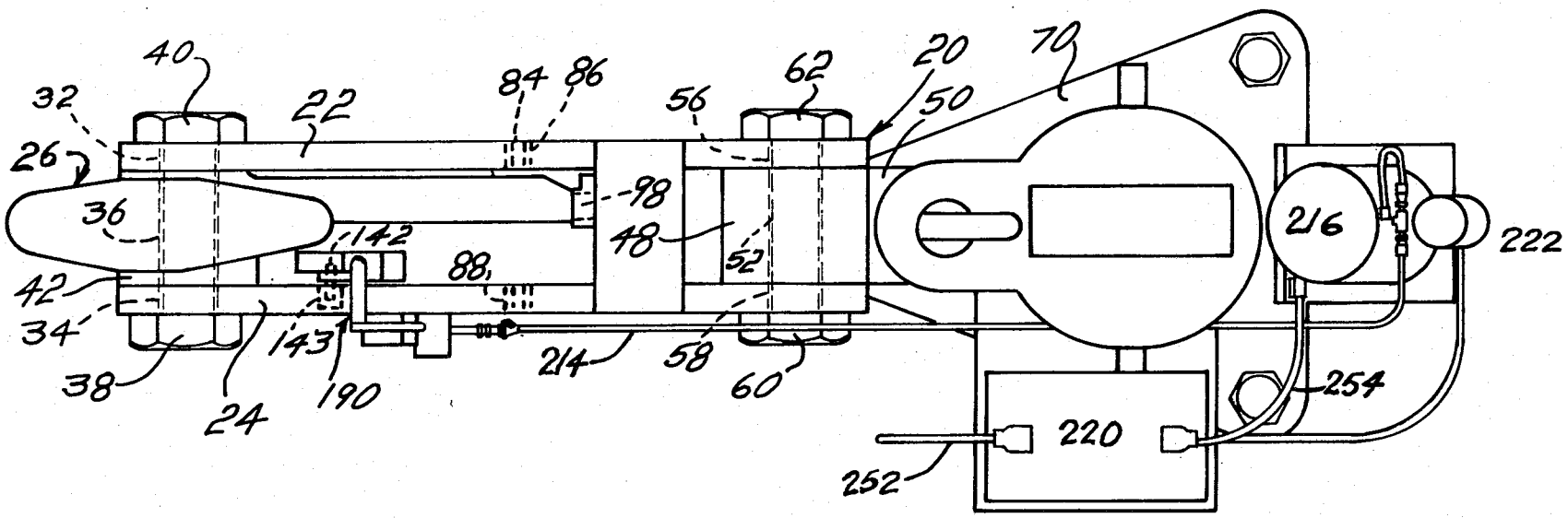
FIG. 1 is a top plan view of a specific embodiment of the releaseable hook of this invention.
Figure 2:
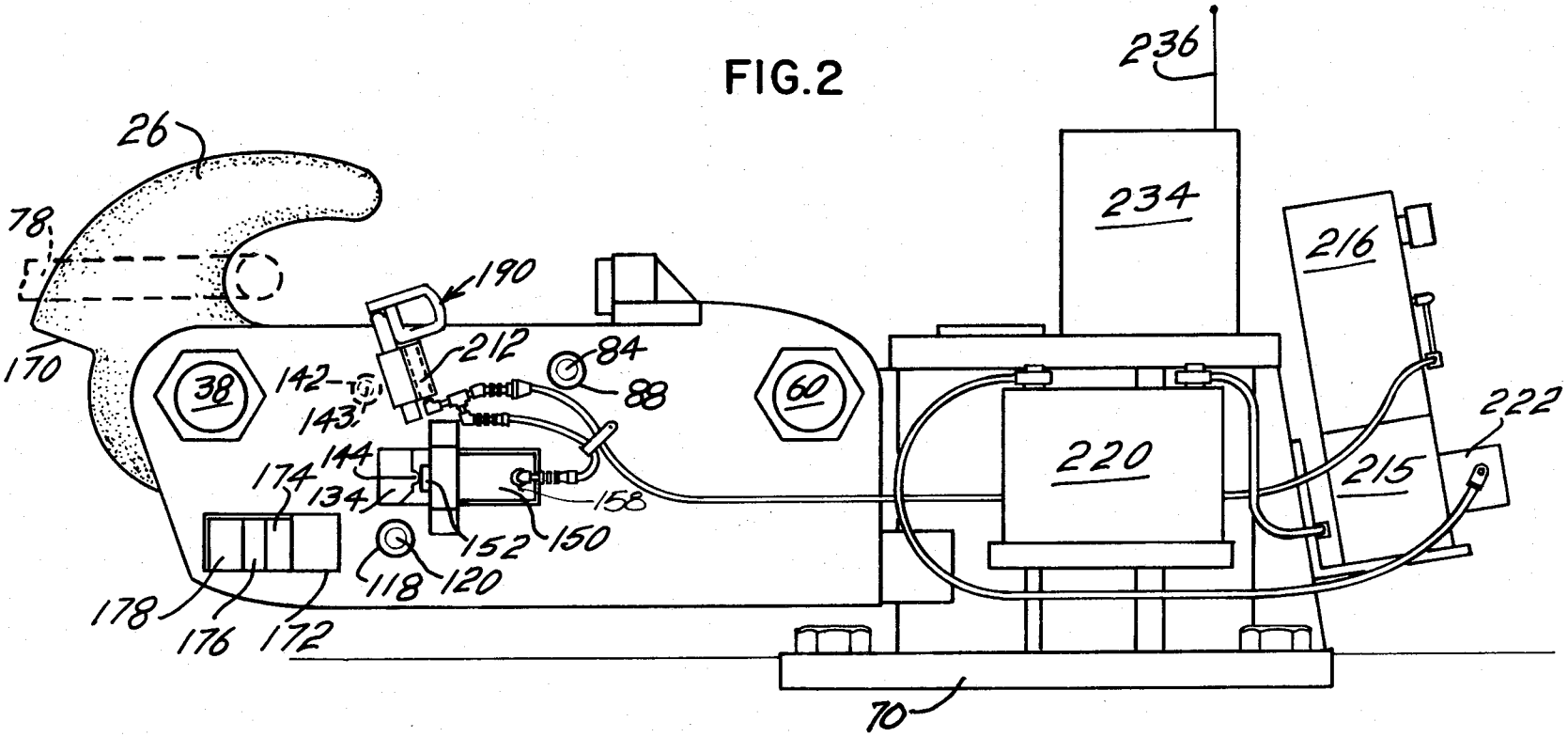
FIG. 2 is a side elevational view of the releaseable hook of this invention.

In FIGS. 1 and 2, it is seen that the main body portion 30 of the U-shaped hook 26 is reduced in thickness so as to be able to accommodate the locking mechanism and the release mechanism positioned between the sides 22 and 24.

At the other end of the sides 22 and 24, there is a crosshead 44.

The crosshead 44 comprises a main body portion 46 having on one side a circular body 48 and on the other side a circular body 50. The circular body 48 has a through passageway 52. The circular body 50 has a through passageway 54.

It is to be noted that the longitudinal axis of the circular body 48 or the passageway 52 is at, substantially, right angles to the longitudinal axis of the circular body 50, or longitudinal passageway 54.

In the side 22 there is a passageway 56 and in the side 24 there is a passageway 58. A bolt 60 projects through the passageway 58 in the side 24, through the passageway 52 in the circular body 48 and through the passageway 56 in the side 22. A nut 62 is screwed onto the bolt 60.

Figure 7:
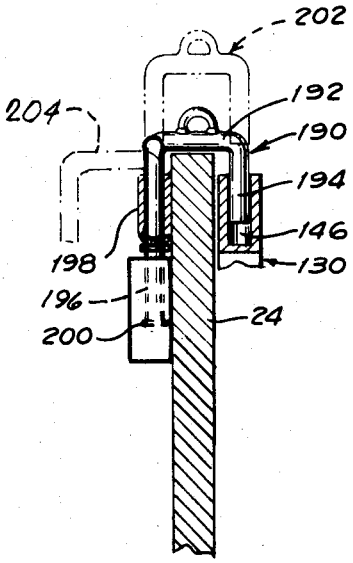
FIG. 7 is a fragmentary, lateral cross-sectional view of a safety lock to restrict movement of the inner lock and thereby to restrict movement of the locking arm and the locking pawl and the rotation of the release hook.
Figure 8:
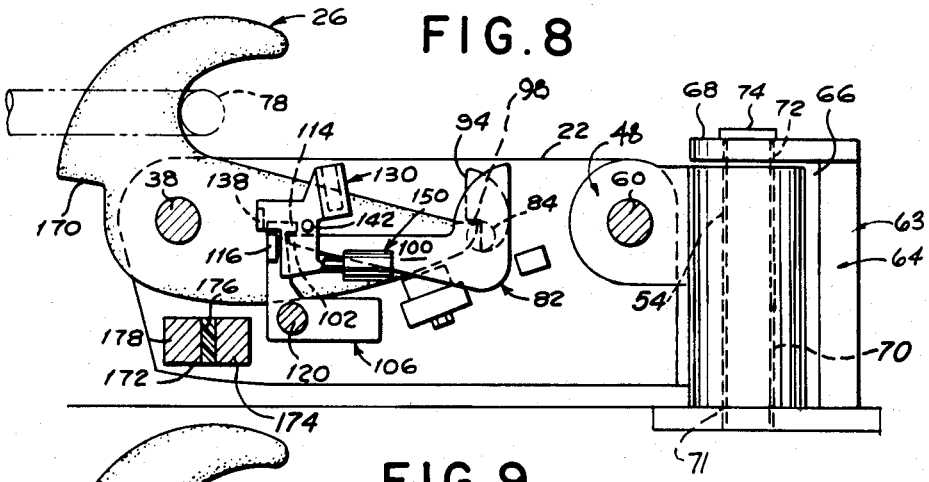
FIG. 8 is a fragmentary view illustrating the relationship of the inner lock, the locking arm, the locking pawl, and the U-shaped release hook with the inner lock locking the locking arm in position to restrict movement of the locking arm and thereby to restrict movement of the locking pawl and the U-shaped hook.
Figure 9:
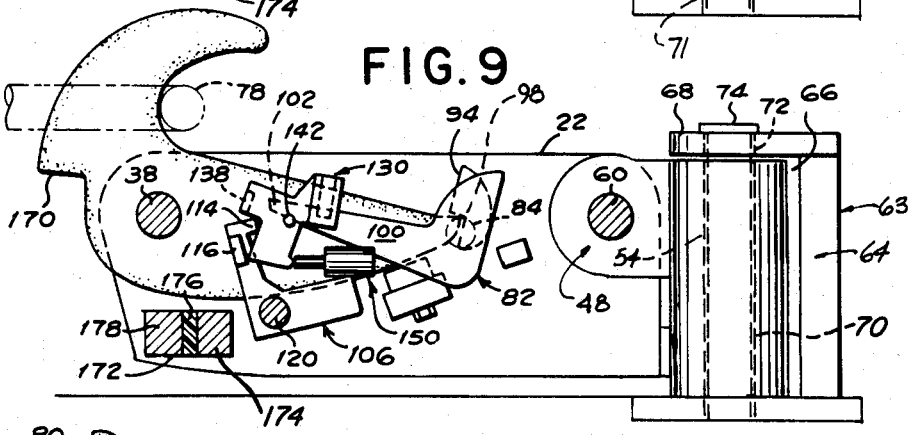
FIG. 9 is a fragmentary view illustrating the inner lock moved away from the locking arm so that the locking arm is free to move away from the locking pawl to allow movement of the locking pawl and in turn to allow rotation of the U-shaped hook.

The circular body 50 connects with a mounting bracket 63. The mounting bracket comprises a body portion 64 having a recess 66. In FIGS. 7, 8 and 9, it appears that the recess 66 defines a U-shaped recess of which the body portion 64 is an outer upright support and on which there is an upper lip or ledge 68. There is a triangular base 70 on which the mounting bracket is positioned.

In the base 70 there is a recess 71 and in the lip or ledge 68, there is a passageway 72. A pin or keeper 74 projects through the passageway 72, the passageway 54 in the circular body 50, and into the recess 71 in the base 70. It is to be understood that the main passageway 54 in the circular body and the recess 71 are larger in diameter than the pin or keeper 74.

It is seen that the adapter or crosshead 44 can rotate in a horizontal pattern around the pin 74 in the mounting bracket 63. Also, it is seen that the releaseable hook 20 can rotate in a vertical path or pattern around the bolt or pin 60. In other words, the release hook can rotate both horizontally and vertically, viz., substantially at right angles to each other, so as to have a wide degree of freedom in horizontal rotation and in vertical rotation and in the combination of horizontal rotation and vertical rotation. In operation, the object is to lock the U-shaped hook 26 in position so as to firmly hold the line 78. There must be mechanism to positively position the U-shaped hook 26 and also there must be a mechanism to release the U-shaped hook 26 for rotation so that the line 78 can slip out of the hook portion 28 and be free.

In FIG. 10, it is seen that on the outer end of the main body portion 30, there is an upwardly or outwardly turned locking surface 80.

In FIGS. 1 and 8, it is seen that the U-shaped hook 26 is locked in position and is not free to rotate to release the line 78.

The locking mechanism comprises a locking pawl 82. The locking pawl 82 has a main shaft 84.

In the side 22, there is a passageway 86 and in the side 24, there is a passageway 88. The main shaft 84 is journaled in the passageways 86 and 88.

Figure 3:
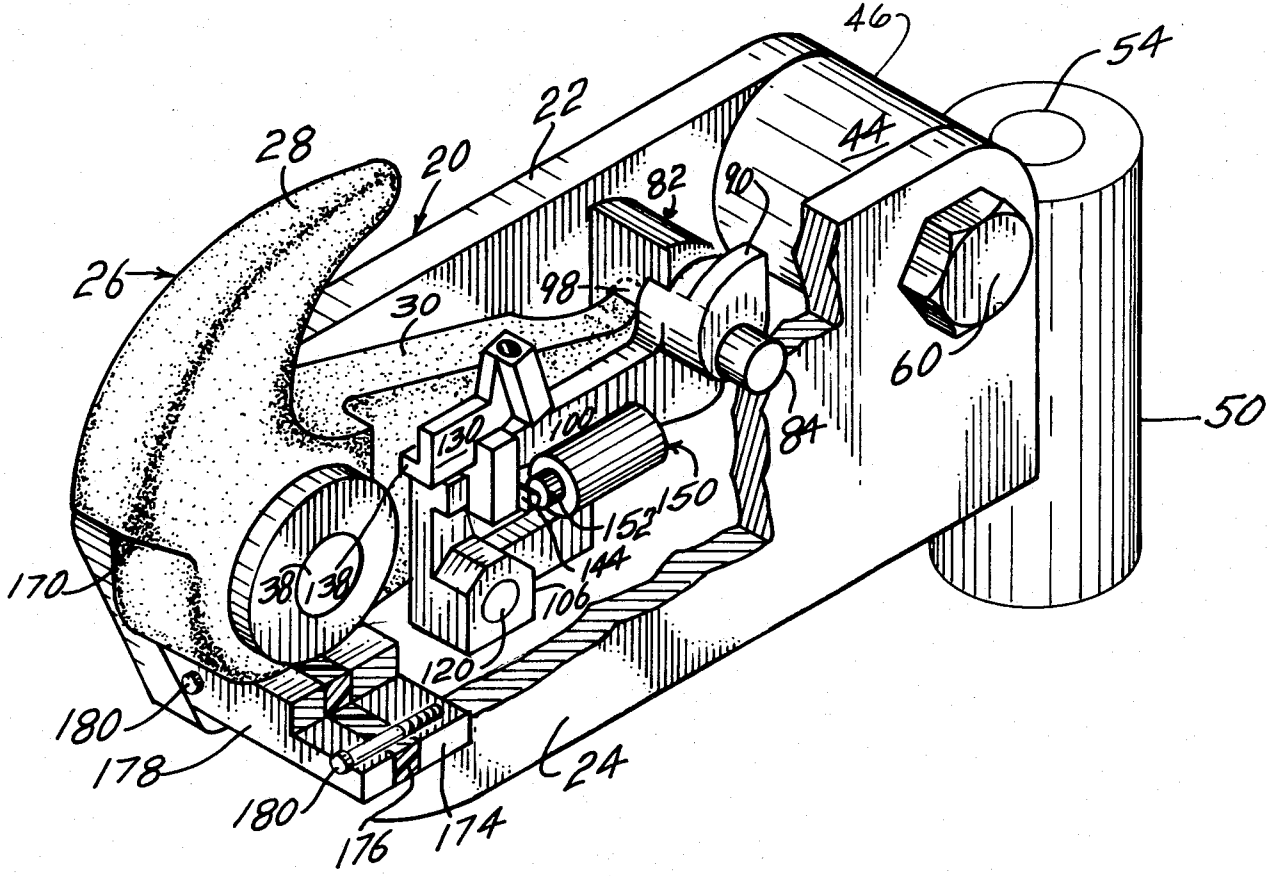
FIG. 3 is a fragmentary, axonometric view looking at part of the locking mechanism for locking the releaseable hook in position for receiving the eye of a rope and also looking at the release mechanism for releasing the releaseable hook to rotate to allow the eye of the rope and the rope to escape from the releaseable hook.

The locking pawl 82 has a stop cam 90 with a flat cam base 92 directed toward the cross head or adapter 44. Also, the locking pawl 82 also has a locking bearing cam 94. In FIG. 3, it is seen that the underneath part which is positioned near the main body of the locking pawl 82 is recessed at 96 into a depth or a cavity. Also, in the underneath part of the locking bearing cam 94, there is a flat surface or a locking bearing surface 98. In FIG. 1, also in FIG. 8, it is seen that the locking surface 80 of the U-shaped hook 26 bears against the locking bearing surface 98 so as to be firmly positioned by the locking bearing surface 98.

The locking pawl 82 has an arm 100 with a tip bearing surface 102.

The locking pawl 82 can be prevented from rotating by means of a locking arm 106. The locking arm 106 has a hub portion 108 and an arm 110 directed toward the shaft 84 of the locking pawl 82. Also, the locking arm 106 has an upwardly directed arm 112 from the hub portion 108. On the end of the upwardly directed arm 112, there is a locking edge 114 which is directed toward the shaft 84 of the locking pawl 82 or directed in the direction of the locking bearing cam 94 and the stop cam 90.

Near the upper end of the upwardly directed arm 112 there is a pawl lug 116. The pawl lug 116 is on that side of the upwardly directed arm 112 as is the hub 108.

In the side 24, there is a passageway 118. There is journaled in the passageway 118 in the side 24, a shaft 120. In the hub 108 of the locking arm 106, there is a passageway 122. The shaft 120 is positioned in the passageway 122.

Figure 5:
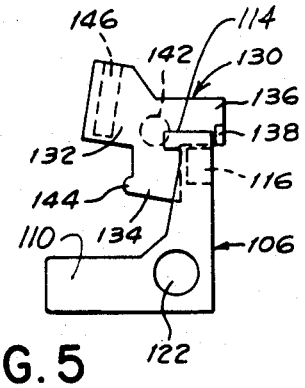
FIG. 5 is a side elevational view looking at the locking arm and the inner lock in such a position that the inner lock prevents movement of the locking arm, and with the prevention of the movement of the locking arm, the locking pawl is restricted in movement.

The locking arm 106 and the shaft 120 are free to rotate with respect to the journaling of the shaft 120 in the passageway 118. In FIG. 5, also in FIGS. 6 and 9, there is illustrated the rotation of the locking arm 106.

Figure 4:
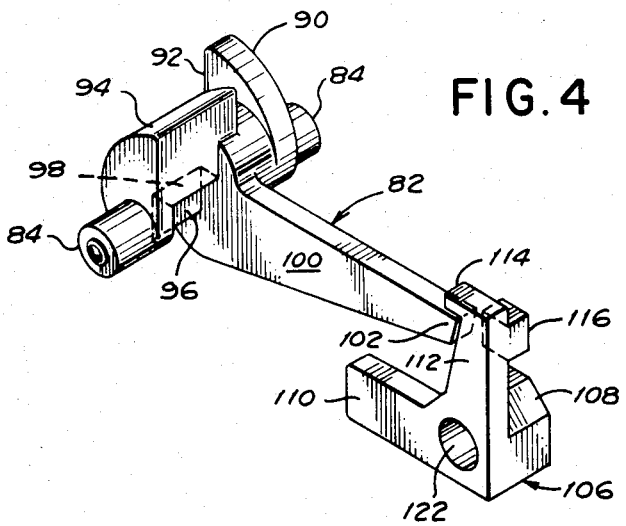
FIG. 4 is an axonometric view looking at the locking pawl and the locking arm with the locking arm preventing the rotation of the locking pawl.

In FIG. 4, it is seen that the locking end 102 of the locking pawl is fixed into position by means of the locking ledge 114 of the locking arm 106. In other words, the locking pawl 82 is locked into position and is not free to rotate so as to allow the U-shaped hook 26 to rotate to release the line 78.

There is an inner lock 130. The inner lock 130 comprises a main body portion 132 with a downwardly directed leg 134 and a rearwardly directed leg 136. On the lower, outer end of the rearwardly directed leg 136, there is a locking lug 138. As is seen in FIG. 3, the locking lug 138 is positioned between the upper end of the leg 112 of the locking arm 106 and the bolt 38 for the U-shaped hook 26. The locking lug 138 prevents the rotation of the locking arm 106. More particularily, with reference to FIG. 5 it is seen that the locking lug 138 prevents the clockwise rotation of the locking arm 106. This means that the locking pawl 82 is fixed in position as the locking end 102 of the locking pawl 82 is prevented to rotate because of the locking edge 114 of the locking arm 106.

Figure 6:
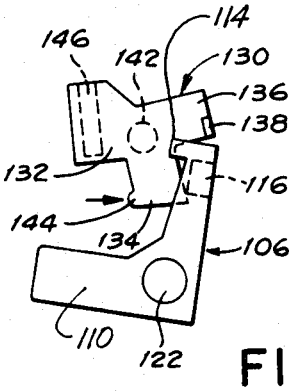
FIG. 6 is a side elevational view illustrating the inner lock and the locking arm with the inner lock moved out of restricting position with respect to the locking arm so as to allow the locking arm to move and thereby allow the locking pawl to move and thereby allow the release hook to rotate to release a line.

More particularly, there is a pin 142 in a recess 143 in the side 24 and which pin 142 is also in the main body of the inner lock 130. As seen in FIGS. 5 and 6 the inner lock 130 is free to rotate.

On the lower part of the downwardly directed leg 134, there is a bearing member or bearing ledge 144. The main body of inner lock 130, see FIGS. 5 and 6, is on the other side of the locking arm 106. The rotation of the inner lock 130 is restricted by the pawl lug 116. In FIGS. 5 and 6, the rotational movement of the inner lock 130 is restricted to movement allowed by the pawl lug 116 on the locking arm 106.

The inner lock 130 has a recess or a cavity 146. The recess or cavity 146 is to receive a safety lock.

A summary to date shows that the U-shaped hook 26 is locked into position with the locking surface 80 bearing against the locking bearing surface 98 of the locking pawl 82, see FIGS. 1, 3 and 4. The locking pawl 82 is locked into position as the locking end 102 of the locking pawl is prevented from movement by the locking ledge 114 of the locking arm 106. If the locking arm 106 were free to move so that the locking ledge 114 could rotate away from the locking end 102 of the locking pawl 82, then the locking pawl 82 would be free to rotate so as to remove the locking bearing surface 98 from the vicinity of the locking surface 80, thereby allowing the U-shaped hook 26 to rotate to free the line 78. To the present, this is not possible because of the locking provisions of the locking arm 106 and the locking pawl 82. To assure the restriction of movement of the locking arm 106 or to assure that the locking arm 106 cannot move, then there is provided the inner lock 130. The locking lug 130 bears against the locking arm 106 so as to prevent rotation of the locking arm 106. There is provided a definite and positive locking means to prevent rotation of the locking arm 106 and the locking pawl 82 and the U-shaped hook 26.

With the U-shaped hook 26 locked in position, there must be a means to release the U-shaped hook 26 so that it can rotate to allow the line 78 to escape from the hook 26.

In FIG. 2, there is illustrated a fluid actuated cylinder 150 having a ram 152. There is a fluid line 154 connecting with the cylinder 150 through appropraite fittings. In FIG. 2 there is an opening 158 in the side 24 showing the cylinder 50.

To release the locking mechanism so that the U-shaped hook 26 can rotate to release the line 78, the fluid actuated cylinder 150 can be actuated to extend the plunger 152 to contact the bearing ledge 144, see FIGS. 2, 8, 9 and 10.

In FIG. 5 it is seen that the locking lug 138 prevents the rotation of the locking arm 106. In that position, the ram 152 has not been extended, or has been extended only a slight distance.

With the extension of the ram 152 so as to contact the bearing ledge 144 and to rotate the inner lock 130, see FIG. 6, in the counterclockwise direction, the locking lug 138 is removed from a locking position with respect to the locking arm 106. Then, the locking arm 106 is free to rotate in a clockwise direction so that the locking ledge 114 moves away from the locking end 102 of the locking pawl 82. With respect to FIG. 4, the locking pawl 82 is then in a position to rotate in a counterclockwise manner so that the locking bearing surface 98 is free to rotate away from the locking surface 80 of the U-shaped hook 26. The pull on the line 78 in the U-shaped hook 26 is such as to rotate the U-shaped hook, see FIGS. 8, 9 and 10, in a counterclockwise direction, so that the line 78 escapes from the U-shaped hook 26 and the ship or boat is free to move away from the dock.

In FIGS. 2, 3, 8, 9 and 10, it is seen that on the outer surface of the U-shaped hook 26, at about the junction of the hook portion 28 and the main body portion 30, there is a bumper surface 170.

In the sides 22 and 24, there is a slot or recess 172. There is positioned in the slot or recess 172 an inner metal plate 174, a resilient, flexible means 176, and an outer metal plate 178.

The metal plates 174 and 178 and the flexible, resilient means 176 extend across the lower part of the releaseable hook and extend from one side 22 to the other side 24. The metal plates 174 and 178 and the resilient means 176 are held in position by means of bolts 180 projecting through passageways in the plates in the resilient means and into tapped passageways 182 in the sides 22 and 24. The resilient means 176 is positioned between the metal plates 174 and 178. With the line 78 pulling on the U-shaped hook 26 and the release of the locking mechanism for restricting the movements of the U-shaped hook 26, the line 78 will pull the U-shaped hook 26 so that the bumper surface 170 rotates, in a counterclockwise manner, so as to strike the metal plate 178. The resilient cushion means 176 absorbs and distributes some of the shock of the U-shaped hook 26 hitting the metal plate 178. The resilient means 176 may be of many different compositions. One composition may be a mixture of tetrafluoroethylene and a polyester resin. Another composition for 176 may be a special synthetic rubber or special natural rubber which has been formulated to withstand the shock of being hit by the metal plate 178.

There is a safety catch for preventing rotation of the U-shaped hook 26. This safety catch is such as to lock the inner lock 130 in position by restricting the movement of the inner lock 130. The locking arm 106 locks the locking pawl 82 so that the U-shaped hook 26 cannot rotate to release the line 78. In FIG. 7, there is illustrated a safety hook 190 having a base 192, a short leg 192, and a long leg 196. The short leg 194 can be positioned in the recess 146 of the inner lock 130. There is welded on the outer surface of the side 24 a sleeve 198. At the lower end of the long leg 196, there is a circular ledge or washer 200.

In FIG. 7, with the safety latch shown in dotted line, it is seen that the inner lock 130 is locked in position and cannot move and thereby there is locked in position the locking arm 106, the locking pawl 82, and the U-shaped hook 26 so that the U-shaped hook 26 is not free to move and to rotate.

In FIG. 7, it is seen that in the phantom line, reference numeral 202, the safety catch 190 has been pulled out of the recess 146 of the inner lock 130 so that the inner lock 130 is free to move thereby making it possible for the locking arm 106 to move and to rotate and thereby making it possible for the locking pawl 82 to move and to rotate with the result that the U-shaped hook 26 is free to move and to rotate.

Also, in FIG. 7, it is seen that the latch 190 has been moved and rotated to the position identified by reference numeral 204. The inner lock 130 is free to rotate and likewise, the locking arm 106 is free to rotate and the locking pawl 82 is free to rotate and the U-shaped hook 26 is free to rotate so as to release the line 78.

FIGS. 5 and 6 and also FIGS. 8, 9 and 10 are sequential figures illustrating the position of the elements under certain conditions.

In FIG. 8 the safety catch 190 is out of the recess 146 of the inner lock 130. In this regard reference is made to FIG. 5. The inner lock 130 is free to rotate. The ram 152 of the fluid actuated cylinder 150 is in a retracted position and is not in an extended position. Therefore, the locking ledge 114 of the locking arm 106 is in contact with the locking end of the arm 100 of the pawl 82. Then, the locking bearing surface 98 of the locking bearing cam 94 is in contact with the locking surface 80 of the main body portion 30 of the U-shaped hook 26. With the locking bearing surface 98 in contact with the locking surface 80 the hook 26 is restrained from rotation and cannot release the line 78 or the cable 78.

In FIG. 9, which is similar to FIG. 6, the fluid actuated cylinder 150 has been activated and the ram 152 is extended so as to contact the bearing ledge 144 of the inner lock 130. The inner lock 130 is rotated in a clockwise direction. With the rotation of the inner lock 130 in a clockwise direction the locking lug 138 is moved away or rotated away from the locking arm 106. In other words, the locking arm 106 is no longer in a locked position. This allows the locking arm 106, in FIG. 9, to rotate in a counterclockwise direction. With the rotation of the locking arm 106 in a counterclockwise rotation the locking ledge 114 is rotated away from the locking end 102 of the arm 100 of the pawl 82. The arm 100 of the pawl 82 and the pawl 82 rotate in a clockwise direction. With the rotation of the locking pawl 82 in a clockwise rotation the locking bearing surface 98 is rotated away from the locking surface 80 of the U-shaped hook 26. In other words, the U-shaped hook 26 is no longer locked into position and is free to rotate in a counterclockwise direction to allow the line 78 or the cable 78 to escape from the hook 26.

In FIG. 10 there is illustrated the hook 26 after it has rotated in a counterclockwise direction and there is also illustrated the line 78 or the cable 78 being released or moving away from the hook 26. The pawl 82 has rotated so that the arm 100 is in a upward direction and also the locking bearing surface 98 is in an upward direction.

In FIG. 11 and 12 there is a schematic illustration of the hydraulic system for remotely controlling the release of the U-shaped hook 26 of the releaseable hook 20. In FIGS. 1 and 2 there is an illustration of the remote control unit for releasing the U-shaped hook 26 in the releaseable hook 20.

In FIG. 11 there is a schematic illustration of the hydraulic system 210. There is a cylinder 212 for moving the safety catch 190 out of the recess 146. There is also the cylinder 150 for moving the ram 152 to contact the bearing ledge 144.

There is a fluid line 214 which connects with the motor-pump combination 215. There is a hydraulic reservoir 216 which connects with the motor-pump combination 215 by means of a line 218. The motor-pump combination 215 connects with the ground by means of line 217.

There is a battery 220 which connects with the relay 222 by means of electrical line 224. The battery 220 also connects with the ground by means of electrical line 226. The relay 222 connects with the motor-pump combination 215 by means of electrical line 228. A line 230 connects with the relay 222 and also connects with a receiver 234. The receiver 234 is a radio receiver having an antenna 236 and connects with the ground by line 237.

There is remotely positioned a transmitter 238 having an antenna 240. The transmitter 238 can be positioned a number of miles from the receiver 234.

The hydraulic line 214 connects with TEE 240. The tee by means of line 241 connects with the cylinder 212. Also, the TEE 240 connects with a line 242. In the line 242 there is a flow restrictor 244 or an orifice 244. The line 242 connects with the hydraulic cylinder 150. The flow restrictor 244 is to restrict the flow of hydraulic fluid to the cylinder 150 so that the hydraulic fluid flows, first, to the cylinder 212 to extend the ram 248. Then, after the ram 248 has been extended the hydraulic fluid flows to the cylinder 150. It is necessary to extend the ram 248 to remove the safety catch 190 from the recess 146 before the ram 152 is extended from the cylinder 150. The flow restrictor 244 accomplishes this as it restricts the flow of hydraulic fluid to the cylinder 150. A time period of two or three seconds elapses between the time the ram 248 is extended to remove the safety catch 190 out of the recess 146 and before the buildup of hydraulic fluid and pressure in the cylinder 150 is sufficient to extend the ram 152. The motor-pump combination 215 operates for approximately 2.5 seconds to about 3.0 seconds.

In FIG. 12 there is illustrated the extension of the ram 152 so as to contact the bearing ledge 144 of the locking arm 106. The actuation of the ram 152 and the bearing ledge 144 has been previously explained with respect to FIGS. 5, 6, 8, 9 and 10, and therefore will not be repeated. With the extension of the ram 152 to contact the bearing ledge 144 the U-shaped hook 26 is allowed to rotate, see FIG. 10, in a counterclockwise direction, to allow the eye of the cable 78 or the rope 78 to escape from the hook 26.

In FIG. 13 there is illustrated an electrical system 250 for rotating the inner lock 130 so as to allow the U-shaped hook 26 to rotate, see FIG. 10, in a counterclockwise direction to release the eye of the rope 78 or the cable 78.

In FIG. 13 there is a battery 220 which connects with a relay 222 by means of electrical line. The battery 220 connects with ground by means of line 254. There is a line 256 which connects with the relay solenoid 260. The solenoid 260 has a plunger 262. The plunger 262 is positioned close to the safety catch 190 so that when the plunger 262 is extended the safety catch 190 is moved out of the recess 146. The battery 220 connects with the relay 222 by line 254.

There is a solenoid 264 having a plunger 266. The plunger 266 is positioned so that upon being extended it can contact the bearing ledge 144 of the inner lock 130. There is an electrical line 268 which connects with the line 256 and also connects with the time delay 270. A line 272 interconnects the time delay 270 and the solenoid 264. A line 274 connects with the solenoid 260 and also with the solenoid 264. The line 274 connects with the ground by means of line 276.

The purpose of the time delay 270 is the same as the purpose of the flow restrictor 244 in the hydraulic system 210. It is necessary for the plunger 262 to remove the safety catch 290 out of the recess 146 before the plunger 266 of the solenoid 264 contacts the bearing ledge 144 of the inner lock 130. With the plunger 262 moving the safety catch 190 out of the recess 146 it is then possible for the plunger 266 and the solenoid 264 to bear against the bearing ledge 144 to rotate, see FIG. 10, the inner lock 130 in a clockwise direction. With the rotation of the inner lock 130 in the clockwise direction, as previously explained with respect to FIGS. 5, 6, 8, 9 and 10, the locking bearing surface 98 rotates away from the locking surface 80 of the U-shaped hook 26. This allows the U-shaped hook 26 to rotate, see FIG. 10, in a counterclockwise direction, to release the eye of the rope 78 or the eye of the cable 78. With the release of the rope 78 or the cable 78 the barge or ship or other object to which the rope 78 is attached is then free to move.

Again, there is a receiver 234. The receiver 234 connects with the relay 22 by means of a line 230. The receiver 234 has an antenna 236 as previously stated. Also, there is a transmitter 238 which has an antenna 240. The transmitter 238 can send the electromagnetic signal to the receiver 234 for actuating the solenoid 260 and the plunger 262 and for actuating the solenoid 264 and the plunger 266.

The transmitter 238 and the receiver 234 are commercially available. In the releaseable hook 20 which I have constructed I use a transmitter identified as INTRAC 2000 STATUS UNIT and I use as a receiver INTRAC 2000 TWO FUNCTION CONTROL UNIT. These are a product of Motorola Communications and Electronics, Inc. The range of the transmitter is approximately six to ten miles. This means that the operator of the releaseable hook 20 can be a number of miles away from the releaseable hook and still have the releaseable hook function.

RESUMÉ

This invention is for the remote control of a releaseable hook comprising a rotatable hook 26. There is a transmitter 238 and a receiver 234 with associated electrical and mechanical equipment for the remote control of the releaseable hook. With the transmitter 238 transmitting the instructions to the receiver 234 the rotatable hook can be released so as to rotate to allow the eye of the wire rope 78 to escape from the hook 26. With the remote control of the releaseable hook 20 it is not necessary for a person to travel during adverse weather conditions or under adverse conditions to the hook 20. Also, it is not necessary for the operator to be near the hook 20 when the hook is activated and allowed to rotate. This means that the operator does not have to take a chance of being injured or killed while traveling to the hook 20 and also does not take a chance of being injured or killed while the rotatable hook 26 is rotating.

The rotatable hook 26 is prevented from rotating by the locking pawl 82 having a locking bearing surface 98. The end 80 of the hook 26 bears against the locking bearing surface 98 so as not to be able to rotate. The locking pawl 82 has an arm 100 which is precluded from rotation by a locking arm 106 having a locking ledge 114. The end of the locking ar 100 bears against the locking edge 114 and is prevented from rotating.

There is an inner lock 130 having a locking lug 138. The locking arm 106 bears against the locking lug 138 and is prevented from rotating because of the locking lug 138.

The inner lock 130 has a recess 146. A safety catch 190 is positioned in the recess 146 and prevents the rotation of the inner lock 130.

With the removal of the safety catch 190 the inner lock 130 can rotate so as to allow the locking arm 106 to rotate. With the rotation of the locking arm 106 the locking pawl 82 rotates so as to remove the locking bearing surface 98 away from the end 80 of the rotatable hook 26.

With the transmitter 238 and the receiver 234 and associated hydraulic and electrical equipment the safety catch 190 can be moved out of the recess 146 of the inner lock 130 so as to allow the rotatable hook 26 to rotate to release the eye of the wire rope 78 as previously stated.

There can be used a cylinder 212 and a ram 248 for moving the safety catch 190 out of the recess 146. Or, there can be used a solenoid 260 and a ram 262 for moving the safety catch 190 out of the recess 146. Also, with the transmitter 238 and the receiver 234 and the associated mechanical and electrical equipment the cylinder 150 can be activated for moving the ram or plunger 152 to contact the inner lock 130 for rotating the locking lug 138 away from the locking arm 106. There is a time delay between the time the ram 248 moves the safety catch 190 out of the recess 145 so that the ram 142 contacts and rotates the inner lock 130. This is to insure that the safety catch 190 has been moved out of the recess 146.

Or, there can be used with the transmitter 238 and receiver 234 and associated mechanical and electrical equipment a solenoid 262 having a plunger 264. The plunger 260 of the solenoid 258 moves the safety catch 190 out of the recess 146. There is a time delay between the time the plunger 260 contacts the safety catch 190 and the time the plunger 264 contacts the inner lock 130. Again, this to to make certain that the safety catch 190 have been moved out of the recess 146.

If the safety catch 190 were not moved out of the recess 146 before the ram 152 or the plunger 264 contacted the inner lock 130 there could be a binding action whereby the safety catch 190 could not be moved out of the recess 146 and this would prevent the rotatable hook 26 from rotating to release the eye of the wire rope 78 or cable 78.

It is necessary that the safety catch 190 be out of the recess 146 before the ram 152 or the plunger 264 contacts the inner lock 130 to rotate the inner lock 130.

An object of this invention is to provide a releaseable hook having inherent safety features in that an operator need not be near or in the vicinity of the rotatable hook when releasing the rotatable hook to rotate and to let the eye of a rope or cable slip away. Another safety feature is that the operator does not have to travel over a dangerous path such as rough water and dangerous water in adverse weather conditions to release the rotatable hook to rotate and to let go of the eye of the a rope or cable.

In the preparation of this patent application there is no patent search.

A number of years ago a U.S. Pat. No. 4,034,992, issued to me on July 12, 1977 for a releaseable hook. This invention is an extension of the subject matter of said U.S. Patent in that there is a remote control feature. There is a transmitter of signals at a remote position and a receiver of these transmitted signals near the releaseable hook. The transmitted signals instruct the receiver and electrical units to remove the safety catch 190 from the recess 146 in the inner lock 130. This sets off a chain of reactions for releasing other locks in the releaseable hook 20 so that the rotatable hook 26 can rotate to release the eye of a rope or cable.

35 USC 101 states: "Whoever invents or discovers any new and useful process, machine, manufacture, or composition of matter, or any new and useful improvement thereof, may obtain a patent therefor, subject to the conditions and requirements of this title. July 19, 1952, c. 950, 1.66 Stat. 797."

35 USC 103 states: "A Patent may not be obtained though the invention is not identically desclosed or described as set forth in section 102 of this title, if the difference between the subject matter sought to be patented and the prior art are such that the subject matter as a whole would have been obvious at the time the invention was made to a person having an ordinary skill in the art to which said subject matter pertains. Patentability shall not be negatived by the manner in which the invention was made. July 19, 1952, c 950 1,66 Stat. 798."

I consider the releaseable hook of this patent application to be new and unobvious. Over the years I have received many U.S. patents for releaseable hooks. These are:

| U.S. Pat. No. | Issuing Date |
|---|---|
| 3,761,122 | September 29, 1973 |
| 3,762,757 | October 2, 1973 |
| 3,811,720 | May 21, 1974 |
| 4,034,992 | July 12, 1977 |
| 1,114,586 (Canada) | December 22, 1981 |
| 1,064,074 (Canada) | October 9, 1979 |
| P 26 51 040.7 (Germany) | October 12, 1976 |
| 4,389,907 | June 28, 1983 |

From my background and experience with releaseable hooks I do not know of a remotely controlled releaseable hook where the operator can be many miles away from the releaseable hook and yet release the hook to allow the rotatable hook to rotate to let the eye of a rope or cable slip away from the hook. There is no physical connection between the operator and the releaseable hook. The operator by means of radio signals or electromagnetic waves can control the unlocking of the rotatable hook so that the rotatable hook can rotate to allow the eye of a rope or cable to slip away. To the best of my knowledge and information I have not seen such a teaching as I have disclosed in this instant patent application. Therefore, I consider the subject matter of this instant patent application to be new and unobvious.

Also, I consider the subject matter of this patent application to useful as it allows an operator to remotely operate a rotatable hook for releasing a rope or cable. There is a safety feature in this subject invention as there is less possibility of the operator being hurt or being killed in releasing the rotatable hook. It is not necessary for the operator to travel over rough and dangerous water under adverse conditions to release the hook. Further, it is not necessary for the operator to be near the releaseable hook when releasing the rope or cable from the releaseable hook. By being away from the releaseable hook the operator does not position himself so as to be hurt by the rapidly rotating hook 26 or to be hurt by the horizontal movement of the releaseable hook 20 or by the vertical movement of the hook 20. The operator can be many miles away from the releaseable hook 20 such as up to six miles away from the present teaching. With a more powerful transmitter the operator can be farther than six miles from the releaseable hook.

The purpose of this invention is to have a release hook that can be released by remote control. The release hook can be in a dangerous or hazardous area. The release hook is to be used for mooring large ships, tankers and oil rigs. It's primary purpose is to make it safe for the operator of the release hook to operate the hook. Another way of stating this is that a primary purpose is to keep the operator of the release hook in a safe place and out of danger. The release hook is for use on land, large ships, tankers, oil rigs, docks and the like. The release hook is not for use under water. The release hook is for use on the water or above the water or off of the water but not under the water.

From the foregoing and having presented by invention what I claim is:

1. A releasable hook comprising:

a. a frame;

b. a U-shaped hook having a hook means and a main body portion;

c. a first shaft on said frame;

d. said U-shaped hook being positioned on said first shaft;

e. said U-shaped hook and said frame being rotatable with respect to each other;

f. said hook having a locking surface;

g. a locking pawl;

h. a second shaft on said frame;

i. said locking pawl and said frame being rotatable with respect to each other;

j. said locking pawl having a locking bearing surface for engaging said locking surface of said hook to restrict movement of said U-shaped hook;

k. said locking bearing surface upon rotating away from said U-shaped hook releasing said U-shaped hook to rotate;

l. a control means for controlling the movement of said locking pawl;

m. said control means comprising an actuating unit for allowing said locking pawl to rotate to allow said U-shaped hook to rotate;

n. said actuating unit comprising a receiving means for receiving electromagnetic waves;

o. said actuating unit comprising a transmitting means for transmitting electromagnetic waves to said receiving means;

p. said transmitting means being remotely positioned from said receiving means; and, q. said transmitting means and said receiving means operatively connecting together and being free of a physical connection.

2. A releaseable hook according to claim 1, comprising:

a. a third shaft on said frame;

b. said control means comprising a locking arm mounted on said third shaft;

c. said locking arm having a locking ledge;

d. said locking pawl having a pawl bearing surface;

e. said locking arm and said locking pawl capable of being moved with respect to each other so that said locking ledge and said pawl bearing surface are in a locking relationship to each other;

f. said releaseable hook comprising a safety hook;

g. said safety hook operatively connecting with said locking arm to restrict the movement of said locking arm; and, h. said actuating unit being capable of moving said safety hook away from said locking arm to allow said locking arm to move to allow said locking pawl to move to allow said U-shaped hook to rotate.

3. A releaseable hook according to claim 2, comprising:

a. said control means comprising a first fluid cylinder having a first fluid actuated ram;

b. said first fluid actuated ram being juxtapositioned to said safety hook for moving said safety hook away from said locking arm;

c. a source of fluid under pressure for moving said first fluid actuated ram; and, d. said source of fluid under pressure operatively connecting with said receiving means.

4. A releaseable hook according to claim 3, comprising:

a. said control means comprising a pumping means operatively connecting with said first fluid cylinder for forcing fluid to said first fluid cylinder; and, b. a power means for actuating said pumping means.

5. A releaseable hook according to claim 4, comprising:

a. said power means comprising a battery;

b. said pumping means comprising an electric motor and pump combination; and, c. said receiving means operatively connecting with said electric motor and said battery for actuating said motor to operate said pump for forcing fluid to said first fluid cylinder.

6. A releaseable hook according to claim 3, comprising:

a. said first fluid cylinder being a first hydraulic cylinder; and, b. said source of fluid being hydraulic fluid.

7. A releaseable hook according to claim 6, comprising:

a. said control means comprising a pumping means operatively connecting with said first hydraulic cylinder for forcing hydraulic fluid to said first hydraulic cylinder; and, b. a power means for actuating said pumping means.

8. A releaseable hook according to claim 7, comprising:

a. said power means comprising a battery;

b. said pumping means comprising an electric motor and pump combination; and, c. said receiving means operatively connecting with said electric motor and said battery for actuating said motor to operate said pump for forcing said hydraulic fluid to said hydraulic cylinder.

9. A releaseable hook according to claim 3, comprising:

a. a second fluid cylinder having a second fluid actuated ram;

b. said second fluid actuated ram being juxtapositioned to said locking arm to move said locking arm away from said locking pawl;

c. a source of fluid under pressure for moving said second fluid actuated ram; and, d. said source of fluid under pressure operatively connecting with said receiving means.

10. A releaseable hook according to claim 9, comprising:

a. a time delay means associated with said second fluid cylinder to delay the movement of said second fluid actuated ram until after said first fluid actuated ram has moved.

11. A releaseable hook according to claim 10, comprising:

a. said first fluid cylinder being first hydraulic cylinder;

b. said source of fluid being hydraulic fluid; and, c. said second fluid cylinder being a second hydraulic cylinder.

12. A releasable hook according to claim 11, comprising:

a. said control means comprising a pumping means operatively connecting with said first hydraulic cylinder for forcing hydraulic fluid to said first hydraulic cylinder; and, b. a power means for actuating said pumping means.

13. A releasable hook according to claim 12, comprising:

a. said power means comprising a battery;

b. said pumping means comprising an electric motor and pump combination; and, c. said receiving means operatively connecting with said electric motor and said battery for actuating said motor to operate said pump for forcing said hydraulic fluid to said hydraulic cylinder and to said second hydraulic cylinder.

14. In a releaseable hook comprising:

a. a frame;

b. a U-shaped hook having a hook means and a main body portion;

c. a first shaft on said frame;

d. said U-shaped hook being positioned on said first shaft;

e. said U-shaped hook and said frame being rotatable with respect to each other;

f. said hook having a locking surface;

g. a locking panel;
h. a second shaft on said frame;
i. said locking pawl and said frame being rotatable with respect to each other;
j. said locking pawl having a locking bearing surface for engaging said locking surface of said hook to restrict movement of said U-shaped hook;
k. said locking bearing surface upon rotating away from said U-shaped hook releasing said U-shaped hook to rotate;

an improvement comprising:

l. a control means for controlling the movement of said locking pawl;
m. said control means comprising an actuating unit for allowing said locking pawl to rotate to allow said U-shaped hook to rotate;
n. said actuating unit comprising a receiving means for receiving electromagnetic waves;
o. said actuating unit comprising a transmitting means for transmitting electromagnetic waves to said receiving means;
p. said transmitting means being remotely positioned from said receiving means; and,
q. said transmitting means and said receiving means operatively connecting together and being free of a physical connection.

15. In a releaseable hook according to claim 14, comprising:

a. a third shaft on said frame;
b. said control means comprising a locking arm mounted on said third shaft;
c. said locking arm having a locking ledge;
d. said locking pawl having a pawl bearing surface;
e. said locking arm and said locking pawl capable of being moved with respect to each other so that said locking ledge and said pawl bearing surface are in a locking relationship to each other;
f. a releaseable hook comprising a safety hook;
g. said safety hook operatively connecting with said locking arm to restrict the movement of said locking arm; and,
h. said actuating unit being capable of moving said safety hook away from said locking arm to allow said locking arm to move to allow said locking pawl to move to allow said U-shaped hook to rotate.

16. In a releaseable hook according to claim 15, comprising:

a. said control means comprising a first fluid cylinder having a first fluid actuated ram;
b. said first fluid actuated ram being juxtapositioned to said safety hook for moving said safety hook away from said locking arm;
c. a source of fluid under pressure for moving said first fluid actuated ram; and,
d. said source of fluid under pressure operatively connecting with said receiving means.

17. In a releaseable hook according to claim 16, comprising:

a. said control means comprising a pumping means operatively connecting with said first fluid cylinder for forcing fluid to said first fluid cylinder; and,
b. a power means for actuating said pumping means.

18. In a releaseable hook according to claim 16, comprising:

a. said power means comprising a battery;
b. said pumping means comprising an electric motor and pump combination; and,
c. said receiving means operatively connecting with said electric motor and said battery for actuating said motor to operate said pump for forcing fluid to said first fluid cylinder.

19. In a releaseable hook according to claim 16, comprising:

a. said first fluid cylinder being a first hydraulic cylinder; and,
b. said source of fluid being hydraulic fluid.

20. In a releaseable hook according to claim 19, comprising:

a. said control means comprising a pumping means operatively connecting with said first hydraulic cylinder for forcing hydraulic fluid to said first hydraulic cylinder; and,
b. a power means for actuating said pumping means.

21. In a releaseable hook according to claim 20, comprising:

a. said power means comprising a battery;
b. said pumping means comprising an electric motor and pump combination; and,
c. said receiving means operatively connecting with said electric motor and said battery for actuating said motor to operate said pump for forcing said hydraulic fluid to said hydraulic cylinder.

22. In a releaseable hook according to claim 16, comprising:

a. a second fluid cylinder having a second fluid actuated ram;
b. said second fluid actuated ram being juxtapositioned to said locking arm to move said locking arm away from said locking pawl;
c. a source of fluid under pressure for moving said second fluid actuated ram; and,
d. said source of fluid under pressure operatively connecting with said receiving means.

23. In a releasable hook according to claim 22, comprising:

a. a time delay means associated with said second fluid cylinder to delay the movement of said second fluid actuated ram until after said first fluid actuated ram has moved.

24. In a releaseable hook according to claim 23, comprising:

a. said first fluid cylinder being a first hydraulic cylinder;
b. said source of fluid being hydraulic fluid; and,
c. said second fluid cylinder being a second hydraulic cylinder.

25. In a releaseable hook according to claim 24, comprising:

a. said control means comprising a pumping means operatively connecting with said first hydraulic cylinder for forcing hydraulic fluid to said first hydraulic cylinder; and,
b. a power means for actuating said pumping means.

26. In a releaseable hook according to claim 25, comprising:

a. said power means comprising a battery;
b. said pumping means comprising an electric motor and pump combination; and,
c. said receiving means operatively connecting with said electric motor and said battery for actuating said motor to operate said pump for forcing said hydraulic fluid to said hydraulic cylinder and to said second hydraulic cylinder.

27. A releaseable hook comprising:

a. a frame;

b. a U-shaped hook having a hook means and a main body portion;
c. a first shaft on said frame;
d. said U-shaped hook being positioned on said first shaft;
e. said U-shaped hook and said frame being rotatable with respect to each other;
f. said hook having a locking surface;
g. a locking pawl;
h. a second shaft on said frame;
i. said locking pawl and said frame being rotatable with respect to each other;
j. said locking pawl having a locking bearing surface for engaging said locking surface of said hook to restrict movement of said U-shaped hook;
k. said locking bearing surface upon rotating away from said U-shaped hook releasing said U-shaped hook to rotate;
l. a control means for controlling the movement of said locking pawl;
m. said control means comprising an actuating unit for allowing said locking pawl to rotate to allow said U-shaped hook to rotate;
n. said actuating unit comprising a servient unit for allowing said locking pawl to rotate to allow said U-shaped hook to rotate; and,
o. said actuating unit comprising a master unit for controlling said servient unit.

28. A releaseable hook according to claim 27, comprising:
a. said servient unit comprising a receiving means for receiving electromagnetic waves;
b. said master unit comprising a transmitting means for transmitting electromagnetic waves to said servient unit;
c. said transmitting means being remotely positioned from said receiving means; and,
d. said transmitting means and said receiving means operatively connecting together and being free of a physical connection.

29. A releaseable hook according to claim 27, comprising:
a. said servient unit and said master unit physically connecting with each other.

30. A releaseable hook according to claim 27, comprising:
a. a third shaft on said frame;
b. said control means comprising a locking arm mounted on said third shaft;
c. said locking arm having a locking ledge;
d. said locking pawl having a pawl bearing surface;
e. said locking arm and said locking pawl capable of being moved with respect to each other so that said locking ledge and said pawl bearing surface are in a locking relationship to each other;
f. said releaseable hook comprising a safety hook; and,
g. said safety hook operatively connecting with said locking arm to restrict the movement of said locking arm.

31. A releaseable hook according to claim 27, comprising:
a. said control means comprising a first fluid cylinder having a first fluid actuated ram;
b. said first fluid actuated ram being juxtapositioned to said safety hook for moving said safety hook away from said locking arm;
c. a source of fluid under pressure for moving said first fluid actuated ram; and,
d. said source of fluid under pressure operatively connecting with said receiving means.

32. A releaseable hook according to claim 31, comprising:
a. said control means comprising a pumping means operatively connecting with said first fluid cylinder for forcing fluid to said first fluid cylinder; and,
b. a power means for actuating said pumping means.

33. A releaseable hook according to claim 32, comprising:
a. said power means comprising a battery;
b. said pumping means comprising an electric motor and pump combination; and,
c. said receiving means operatively connecting with said electric motor and said battery for actuating said motor to operate said pump for forcing fluid to said first fluid cylinder.

34. A releaseable hook according to claim 31, comprising:
a. said first fluid cylinder being a first hydraulic cylinder; and,
b. said source of fluid being hydraulic fluid.

35. A releaseable hook according to claim 34, comprising:
a. said control means comprising a pumping means operatively connecting with said first hydraulic cylinder for forcing hydraulic fluid to said first hydraulic cylinder, and,
b. a power means for actuating said pumping means.

36. A releaseable hook according to claim 35, comprising:
a. said power means comprising a battery;
b. said pumping means comprising an electric motor and pump combination; and,
c. said receiving means operatively connecting with said electric motor and said battery for actuating said motor to operate said pump for forcing said hydraulic fluid to said hydraulic cylinder.

37. A releaseable hook according to claim 31, comprising:
a. a second fluid cylinder having a second fluid actuated ram;
b. said second fluid actuated ram being juxtapositioned to said locking arm to move said locking arm away from said locking pawl;
c. a source of fluid under pressure for moving said second fluid actuated ram; and,
d. said source of fluid under pressure operatively connecting with said receiving means.

38. A releaseable hook according to claim 37, comprising:
a. a time delay means associated with said second fluid cylinder to delay the movement of said second fluid actuated ram until after said first fluid actuated ram has moved.

39. A releaseable hook according to claim 38, comprising:
a. said first fluid cylinder being a first hydraulic cylinder;
b. said source of fluid being hydraulic fluid; and,
c. said second fluid cylinder being a second hydraulic cylinder.

40. A releaseable hook according to claim 39, comprising:
a. said control means comprising a pumping means operatively connecting with said first hydraulic cylinder for forcing hydraulic fluid to said first hydraulic cylinder; and, b. a power means for actuating said pumping means.

41. A releaseable hook according to claim 30, comprising:

a. said power means comprising a battery;

b. said pumping means comprising an electric motor and pump combination; and, c. said receiving means operatively connecting with said electric motor and said battery for actuating said motor to operate said pump for forcing said hydraulic fluid to said hydraulic cylinder and to said second hydraulic cylinder.

42. In a releaseable hook comprising:

a. a frame;

b. a U-shaped hook having a hook means and a main body portion;

c. a first shaft on said frame;

d. said U-shaped hook being positioned on said first shaft;

e. said U-shaped hook and said frame being rotatable with respect to each other;

f. said hook having a locking surface;

g. a locking pawl;

h. a second shaft on said frame;

i. said locking pawl and said frame being rotatable with respect to each other;

j. said locking pawl having a locking bearing surface for engaging said locking surface of said hook to restrict movement of said U-shaped hook;

k. said locking bearing surface upon rotating away from said U-shaped hook releasing said U-shaped hook to rotate;

an improvement comprising:

l. a control means for controlling the movement of said locking pawl;

m. said control means comprising an actuating unit for allowing said locking pawl to rotate to allow said U-shaped hook to rotate;

n. said actuating unit comprising a servient unit for allowing said locking pawl to rotate to allow said U-shaped hook to rotate; and, o. said actuating unit comprising a master unit for controlling said servient unit.

43. In a releaseable hook according to claim 42, comprising:

a. said servient unit comprising a receiving means for receiving electromagnetic waves;

b. said master unit comprising a transmitting means for transmitting electromagnetic waves to said servient unit;

c. said transmitting means being remotely positioned from said receiving means; and, d. said transmitting means and said receiving means operatively connecting together and being free of a physical connection.

44. In a releaseable hook according to claim 42, comprising:

a. said servient unit and said master unit physically connecting with each other.

45. In a releaseable hook according to claim 42, comprising:

a. a third shaft on said frame;

b. said control means comprising a locking arm mounted on said third shaft;

c. said locking arm having a locking ledge;

d. said locking pawl having a pawl bearing surface;

e. said locking arm and said locking pawl capable of being moved with respect to each other so that said locking ledge and said pawl bearing surface are in a locking relationship to each other;

f. said releaseable hook comprising a safety hook; and, g. said safety hook operatively connecting with said locking arm to restrict the movement of said locking arm.

46. In a releaseable hook according to claim 42, comprising:

a. said control means comprising a first fluid cylinder having a first fluid actuated ram;

b. said first fluid actuated ram being juxtapositioned to said safety hook for moving said safety hook away from said locking arm;

c. a source of fluid under pressure for moving said first fluid actuated ram; and, d. said source of fluid under pressure operatively connecting with said receiving means.

47. In a releaseable hook according to claim 46, comprising:

a. said control means comprising a pumping means operatively connecting with said first fluid cylinder for forcing fluid to said first fluid cylinder; and, b. a power means for actuating said pumping means.

48. In a releaseable hook according to claim 47, comprising:

a. said power means comprising a battery;

b. said pumping means comprising an electric motor and pump combination; and, c. said receiving means operatively connecting with said electric motor and said battery for actuating said motor to operate said pump for forcing fluid to said first fluid cylinder.

49. In a releaseable hook according to claim 46, comprising:

a. said first fluid cylinder being a first hydraulic cylinder; and, b. said source of fluid being hydraulic fluid.

50. In a releaseable hook according to claim 49, comprising:

a. said control means comprising a pumping means operatively connecting with said first hydraulic cylinder for forcing hydraulic fluid to said first hydraulic cylinder; and, b. a power means for actuating said pumping means.

51. In a releaseable hook according to claim 50, comprising:

a. said power means comprising a battery;

b. said pumping means comprising an electric motor and pump combination; and, c. said receiving means operatively connecting with said electric motor and said battery for actuating said motor to operate said pump for forcing said hydraulic fluid to said hydraulic cylinder.

52. In a releaseable hook according to claim 46, comprising:

a. a second fluid cylinder having a second fluid actuated ram;

b. said second fluid actuated ram being juxtapositioned to said locking arm to move said locking arm away from said locking pawl;

c. a source of fluid under pressure for moving said second fluid actuated ram; and, d. said source of fluid under pressure operatively connecting with said receiving means.

53. In a releaseable hook according to claim 52, comprising:

a. a time delay means associated with said second fluid cylinder to delay the movement of said second fluid actuated ram until after said first fluid actuated ram has moved.

54. In a releaseable hook according to claim 53, comprising:

a. said first fluid cylinder being a first hydraulic cylinder;

b. said source of fluid being hydraulic fluid; and, c. said second fluid cylinder being a second hydraulic cylinder 55. In a releaseable hook according to claim 54, comprising:

a. said control means comprising a pumping means operatively connecting with said first hydraulic cylinder for forcing hydraulic fluid to said first hydraulic cylinder; and, b. a power means for actuating said pumping means.

56. In a releaseable hook according to claim 55, comprising:

a. said power means comprising a battery;

b. said pumping means comprising an electric motor and pump combination; and, c. said receiving means operatively connecting with said electric motor and said battery for actuating said motor to operate said pump for forcing said hydraulic fluid to said hydraulic cylinder and to said second hydraulic cylinder.

* * * * *